US008305010B2

(12) United States Patent
Kamata et al.

(10) Patent No.: US 8,305,010 B2
(45) Date of Patent: Nov. 6, 2012

(54) LIGHT-EMITTING DIODE LIGHTING DEVICE WITH STEP-DOWN CHOPPER

(75) Inventors: Masahiko Kamata, Yokohama (JP); Hajime Osaki, Yokosuka (JP); Hirokazu Otake, Yokosuka (JP); Shinya Hakuta, Yokohama (JP); Takuro Hiramatsu, Yokohama (JP); Toshiyuki Hiraoka, Numazu (JP); Naoko Iwai, Yokohama (JP)

(73) Assignees: Toshiba Lighting & Technology Corporation, Kanagawa (JP); Kabushiki Kaisha Toshiba, Tokyo (JP)

( * ) Notice: Subject to any disclaimer, the term of this patent is extended or adjusted under 35 U.S.C. 154(b) by 533 days.

(21) Appl. No.: 12/579,784

(22) Filed: Oct. 15, 2009

(65) Prior Publication Data

US 2010/0097007 A1 Apr. 22, 2010

(30) Foreign Application Priority Data

Oct. 17, 2008 (JP) ..... 2008-269113
Dec. 26, 2008 (JP) ..... 2008-333679
Mar. 16, 2009 (JP) ..... 2009-062254

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| *H05B 37/00* | (2006.01) |
| *H05B 39/00* | (2006.01) |
| *H05B 41/14* | (2006.01) |
| *H05B 39/02* | (2006.01) |
| *H05B 43/00* | (2006.01) |
| *H05B 41/24* | (2006.01) |

(52) U.S. Cl. ..... 315/297; 315/200 R; 315/209 R; 315/227 R; 315/246

(58) Field of Classification Search ..... None
See application file for complete search history.

(56) References Cited

U.S. PATENT DOCUMENTS 4,688,162 A 8/1987 Mutoh et al.
(Continued)

FOREIGN PATENT DOCUMENTS

EP 0 599 000 A1 6/1994
(Continued)

OTHER PUBLICATIONS

Japanese Office Action, and English translation thereof, issued in Japanese Patent Application No. 2008-269113 dated May 23, 2012.

*Primary Examiner* — Douglas W Owens
*Assistant Examiner* — Dedei K Hammond
(74) *Attorney, Agent, or Firm* — McDermott Will & Emery LLP

(57) ABSTRACT

There is provided an LED lighting device having a satisfactory temperature characteristic and a small amount of variation in output current. The step-down chopper is provided with a first circuit including the switching element, the impedance means and a first inductor connected in series and a second circuit including the first inductor and a diode connected in series. A self-excited drive signal generation circuit is provided with a second inductor magnetically coupled with the first inductor and applies a voltage induced in the second inductor to the switching element to keep the switching element on. A turn-off circuit outputs an output voltage when the voltage of the impedance means detected by a comparator exceeds the reference value, and the output voltage allows a switching element to turn on to short-circuit the output terminals of the self-excited drive signal generation circuit, resulting in that the switching element is turned off.

4 Claims, 6 Drawing Sheets

U.S. PATENT DOCUMENTS

| | | | |
|---|---|---|---|
| 5,771,164 | A | 6/1998 | Murai et al. |
| 2007/0152604 | A1 | 7/2007 | Tatsumi |

FOREIGN PATENT DOCUMENTS

| | | | | |
|---|---|---|---|---|
| JP | 6-014545 | A | | 1/1994 |
| JP | 11-345694 | A | | 12/1999 |
| JP | 2004-119078 | A | | 4/2004 |
| JP | 2004119078 | A | * | 4/2004 |
| JP | 2004-296205 | A | | 10/2004 |
| JP | 2005-294063 | A | | 10/2005 |
| JP | 2008235530 | A | | 10/2008 |
| WO | 03/039206 | A1 | | 5/2003 |

* cited by examiner

LIGHT-EMITTING DIODE LIGHTING DEVICE WITH STEP-DOWN CHOPPER

INCORPORATION BY REFERENCE

The present invention claims priority under 35 U.S.C. §119 to Japanese Patent Application Nos. 2008-269113, 2008-333679 and 2009-062254 filed on Oct. 17, 2008, Dec. 26, 2008 and Mar. 16, 2009, respectively. The contents of these applications are incorporated herein by reference in their entirety.

FIELD OF THE INVENTION

The present invention relates to a light-emitting diode lighting device provided with a step-down chopper.

BACKGROUND OF THE INVENTION

LED (light-emitting diode) lighting devices provided with a step-down chopper are known, one of which is disclosed in, for example, patent document (Japanese Patent Publication No. 4123886). In this type of LED lighting device, a resistor element having a low resistance is connected between a FET serving as a first switching element and a first inductor, and this resistor element is connected between the base and the emitter of a bipolar transistor serving as a second switching element. The collector of the transistor is connected to the gate terminal of the FET.

When the FET is turned on, a current flows from a direct-current power supply via the resistor element, the first inductor and a capacitor connected parallel to an LED circuit serving as a load. When this current gradually increases and a voltage across the resistor element reaches a bias that allows the transistor to operate, the transistor is turned on, and thus the FET is turned off. Since the voltage across the resistor element is the base bias of the transistor, and this voltage reaches a predetermined voltage to allow the turning on of the transistor and thus the turning off of the FET, it is possible to accurately have a timing of the turning off without the timing being affected by a voltage induced by the second inductor. That is, it is possible to accurately perform the switching operation of the FET at all times. Then, when the charging voltage of the capacitor is equal to or more than the forward voltage of the LED circuit, a current flows through the LED circuit, with the result that the LED included in the LED circuit starts to light.

Since, in the case of a silicon transistor, a base bias for allowing the transistor to be turned on is so low as to be 0.5 volts, almost no electric power is consumed by a resistor element, and thus it is possible to prevent unnecessary power consumption as much as possible.

However, in the conventional LED lighting device, it is required to further reduce the power loss of the resistor element connected in series with the first switching element. Moreover, since the temperature characteristic of the first switching element is determined by the temperature characteristic of the transistor, it is disadvantageously difficult to provide a desired temperature characteristic for the first switching element.

It is an object of the present invention to provide an LED lighting device that can further reduce the power loss of impedance means connected in series with a switching element serving as a step-down chopper and that has a satisfactory temperature characteristic and a small amount of variation in output current.

SUMMARY OF THE INVENTION

According to the present invention, there is provided a light-emitting diode lighting device including: a direct-current power supply; a step-down chopper including: an input terminal connected to the direct-current power supply; an output terminal connected to a load; a switching element; a first circuit that includes impedance means and a first inductor connected in series and that is connected between the input terminal and the output terminal; and a second circuit that includes the first inductor and a diode connected in series and that is connected to the output terminal; a light-emitting diode connected, as the load, to the output terminal of the step-down chopper; a self-excited drive signal generation circuit that includes a second inductor magnetically coupled with the first inductor of the step-down chopper and that applies a voltage induced in the second inductor to a control terminal of the switching element as a drive signal to keep the switching element on; and a turn-off circuit including: comparison means that detects a voltage of the impedance means in the step-down chopper and that outputs, when the detected voltage exceeds a reference value, an output voltage; and a switch element that is turned on by the output voltage of the comparison means such that an output terminal of the self-excited drive signal generation circuit is short-circuited and that the switching element is thus turned off.

According to the LED lighting device of the present invention, since the turn-off circuit that turns off the switching element of the step-down chopper includes the switch element short-circuiting the output terminals of the self-excited drive signal generation circuit supplying the drive signal to the switching element of the step-down chopper and the comparison means that is interposed between the impedance means connected in series with the switching element of the step-down chopper and the switch element, and thus operates, when the current flowing through the impedance means reaches a predetermined value, the turn-off circuit to turn off the switching element, it is possible not only to further decrease the impedance of the impedance means to further reduce power loss of the impedance means but also to provide the LED lighting device that has a satisfactory temperature characteristic and a small amount of variation in output current.

The present invention may have the following aspects.

The direct-current power supply supplies to the step-down chopper the power for rectifying, alternating-current power supply, for example, commercial alternating-current power supply voltage to light the LEDs in the form of direct current. The rectification is not particularly limited but is preferably full-wave rectification. The direct-current power supply may be not only the rectification direct-current power supply but also a direct-current power supply formed with a battery or the like. When the direct-current power supply is the rectification direct-current power supply, a smoothing capacitor can be connected between the output terminals thereof to smooth out a direct-current output voltage.

When the rectification direct-current power supply is used, in the alternating-current power supply voltage 100 volts, the capacity of the smoothing capacitor can be 12 to 20 μF and the output voltage of the step-down chopper can be set at 35 to 48 volts while the LEDs are lit. In this aspect, the LED lighting device satisfies the harmonic standard (JIS C61000-3-2 Class C) in which an input current is 25 W or less, and current can be continuously supplied to the LEDs with respect to a reduction in the capacity of the smoothing capacitor that can be used, and thus it is possible to extend the circuit life.

The step-down chopper includes the first and second circuits, and is a known chopper circuit in which a switching element and a first inductor are connected in series with an input terminal and in which the first inductor and a diode are connected in series with an output terminal. It is known that, allowing the on time of the switching element to be $T_{ON}$, the off time to be $T_{OFF}$, the direct-current power supply voltage to be $V_{IN}$, and the output voltage to be $V_{OUT}$, the output voltage satisfies $V_{OUT}=V_{IN}\cdot T_{ON}/(T_{ON}+T_{OFF})$, and is lower than the input voltage.

The LEDs are connected, as a load, to the output terminal of the step-down chopper, and are lit by the output current of the step-down chopper. The LEDs connected to the output terminal of the step-down chopper may be either a series circuit in which a plurality of LEDs are connected in series or a single LED. A plurality of LEDs may be connected in parallel to each other to constitute a load circuit. Since the light emission characteristics and the package of the LEDs are not particularly limited, it is possible to select from a variety of known light emission characteristics, package forms, ratings and the like, and use them as appropriate.

The self-excited drive signal generation circuit includes the second inductor magnetically coupled with the first inductor of the step-down chopper, and applies, as a drive signal, the voltage induced in the second inductor to the control terminal of the switching element to keep the switching element on. As desired, between the second inductor and the control terminal of the switching element, for example, an impedance element such as a series circuit composed of a capacitor and a resistor can be interposed.

The turn-off circuit includes the comparison means and the switch element, detects the voltage of the impedance means of the step-down chopper, and turns on the switch element with an output signal of the comparison means generated when the detected voltage exceeds the reference value. The switch element short-circuits the output terminals of the self-excited drive signal generation circuit. This short-circuit allows the switching element of the step-down chopper to turn off.

In a case where the turn-off circuit is formed with, for example, a transistor serving as a switch element, in the comparison means, the input voltage can be set at, for example, a voltage of 0.3 volts or less that is obviously lower than the base-emitter voltage generated when the transistor is turned on. In this way, it is possible to reduce the impedance of the impedance means to extremely reduce the power loss produced there.

The comparison means is interposed between the impedance means and the switch element such that the switch element is turned on by the output voltage of the comparison means, and thus the temperature characteristic of the step-down chopper when the step-down chopper is turned off is not affected by the switch element. As a result, a satisfactory temperature characteristic of the LED lighting device is obtained. Specifically, if the comparison means compares the input voltage with the reference voltage set internally and the input voltage exceeds the reference voltage, the comparison means amplifies the input voltage to a high voltage to output it. Typically, the reference voltage is set with a Zener diode. Since the temperature characteristic of the comparison means is substantially determined by the temperature characteristic of the Zener diode that sets the reference voltage, it is easy to select a Zener diode that has a negative or flat temperature characteristic suitable as the temperature characteristic of the turn-off circuit. Since the turn-off control of the switching element of the step-down chopper is performed by the operation of the comparison means, variations in the output current of the step-down chopper are easily controlled, and are reduced.

In the present invention, the turn-off circuit including the comparison means and the switch element can be mainly formed with a voltage comparator using an operational amplifier, that is, a comparator. In this case, either a first aspect in which the turn-off circuit is composed of the comparator and the switch element that is turned on by the output voltage of the comparator or a second aspect in which the turn-off circuit is composed of only a comparator having a relatively large sink current capacity may be used. In the second aspect, since the comparator itself has a relatively large sink current capacity and thus has the function of the switch element, there is no need for an additional switch element.

According to a preferred third aspect of the present invention, the light-emitting diode lighting device described above includes: a third inductor magnetically coupled with the first inductor of the step-down chopper; and an overvoltage protection circuit that turns off, when a voltage induced by the third inductor exceeds a predetermined value, the switching element of the step-down chopper.

In the overvoltage protection circuit, when the output voltage becomes an overvoltage due to the failure of the load, a voltage induced in the third inductor is proportionally increased. This makes it possible to operate the overvoltage protection circuit to turn off the switching element of the step-down chopper, with the result that the circuit can be protected.

In the overvoltage protection circuit, when the voltage induced in the third inductor becomes abnormally high by using the comparator, a negative voltage is preferably output. Then, the negative output voltage is applied to the control terminal of the switching element of the step-down chopper. In this way, the switching element is turned off and the step-down chopper is stopped, and thus the protection operation is performed.

According to the third aspect, since the third inductor magnetically coupled with the first inductor of the step-down chopper and the overvoltage protection circuit that turns off, when the voltage induced exceeds the predetermined value, the switching element of the step-down chopper are provided, and thus the protection operation is performed when the output voltage becomes an overvoltage due to the failure of the load, it is possible to turn off the LEDs serving as the load before they are damaged.

According to a preferred fourth aspect of the present invention, in the configuration described above, a photocoupler is connected in parallel to the reference voltage source for the comparator in the turn-off circuit, and the photocoupler is driven according to a light adjustment signal of the PWM method. When the light adjustment signal is not a signal of the PWM method, preferably, the PWM signal is obtained with a conversion circuit that converts the light adjustment signal into the PWM signal, and then the photocoupler is driven by it.

According to the fourth aspect, it is possible to obtain an LED lighting device having the light adjustment function.

In the light-emitting diode lighting device of the present invention, the direct-current power supply includes a rectification circuit that rectifies an alternating-current voltage and a smoothing capacitor that smoothes out a direct-current voltage resulting from the rectification by the rectification circuit, the step-down chopper includes an output capacitor connected between the output terminals, the proportion of a fifth harmonic of an input current waveform of the step-down chopper is equal to or less than 60% and the voltage of the smoothing capacitor is higher than a voltage of the output capacitor over the entire range of an alternating-current voltage period.

The direct-current power supply includes the rectification circuit and the smoothing capacitor. The rectification circuit obtains a direct current by rectifying the alternating-current voltage of an alternating-current power supply, for example, a commercial alternating-current power supply. The alternating-current voltage is not limited to 100 volts. The smoothing capacitor has a predetermined capacitance, and smoothes out the direct-current voltage obtained by the rectification such that the direct-current voltage contains appropriate ripples, with the result that power for lighting the light-emitting diodes is supplied in the form of direct current to the step-down chopper.

The step-down chopper is a known chopper circuit that includes an output capacitor connected between output terminals, and that outputs a low direct-current voltage from an input direct-current voltage.

That is, the series circuit composed of the switching element and the first inductor is connected between one pole of the direct-current power supply and one output terminal of the step-down chopper, and the light-emitting diodes are connected between the connection point between the switching element and the first inductor and the one pole of the direct-current power supply and the other output terminal of the step-down chopper such that the light-emitting diodes are connected in the forward direction with respect to a current output from the first inductor during the off period of the switching element. The output capacitor is connected between the output terminals of the step-down chopper, and the harmonic generated mainly by the switching is bypassed so as not to flow into the light-emitting diodes serving as the load. The switching of the switching element is controlled with a control circuit such as a self-excited drive circuit or a separately-excited drive circuit.

In the present invention, in order that the proportion of the fifth harmonic of the input current waveform is equal to or less than 60% and the voltage of the smoothing capacitor is higher than the voltage of the output capacitor over the entire range of an alternating-current voltage period, for example, it is effective to set the capacitance of the smoothing capacitor in the direct-current power supply as follows.

The capacitance of the smoothing capacitor is first set such that the proportion of the fifth harmonic of the input current waveform is equal to or less than 60%. By satisfying this condition, it is possible not only to make the proportion of the fifth harmonic equal to or less than 60% but also to prevent the proportion of the third harmonic component and the input current from being affected by the peak phase. In particular, it is achieved effectively when the load is for 25 W or less, and, in this way, the harmonic standard for 25 W or less in Japan is also satisfied. Here, this harmonic standard will be specifically described, and the harmonic standard specifies that the proportion of the fifth harmonic of the input current waveform is equal to or less than 61%, the proportion of the third harmonic is equal to or less than 86% and the peak phase of the input current is equal to or less than 65°; these conditions also need to be satisfied. However, since the maximum value of the capacitance of the smoothing capacitor is found to satisfy the conditions of the fifth harmonic, these requirements are not problematic.

Moreover, the capacitance of the smoothing capacitor is secondly set such that the voltage of the smoothing capacitor is higher than the voltage of the output capacitor over the entire range of the alternating-current voltage period. By satisfying this condition, it is possible to continuously and stably operate the step-down chopper over the entire range of the alternating-current voltage period. Although the step-down chopper is operated even when the voltage of the smoothing capacitor is not higher than the voltage of the output capacitor over the entire range of the alternating-current voltage period, it is impossible to perform a stable operation in a period during which the voltage of the smoothing capacitor is lower than the voltage of the output capacitor, and thus the operation is intermittently performed, with the result that the light-emitting diodes are more likely to cause brightness of flickering.

Thus, by making the proportion of the fifth harmonic of the input current waveform of the step-down chopper equal to or less than 60% and making the voltage of the smoothing capacitor higher than the voltage of the output capacitor over the entire range of an alternating-current voltage period, it is possible to provide an LED lighting device that reduces the harmonic of the input current and that makes the step-down chopper stably operate during the entire period of the alternating-current period without causing brightness of flickering.

Preferably, in the configuration described above, the circuit conditions described above are maintained until the life of the smoothing capacitor is ended (for example, when the capacitance is reduced to 80% of the rated value).

When, in order to prevent a failure caused by the harmonic and to satisfy the harmonic standard, the capacitance of the smoothing capacitor is reduced, the number of ripples contained in the rectified voltage is increased, and it is more likely that the voltage of the smoothing capacitor is lower than the voltage of the output capacitor in the step-down chopper during a period of the alternating-current period. To overcome this problem, the output voltage of the step-down chopper is set lower such that the voltage of the output capacitor is lowered, and thus it is possible to make the voltage of the smoothing capacitor higher than the voltage of the output capacitor during the entire alternating-current voltage.

However, since the circuit efficiency tends to decrease as the ratio of the voltage of the output capacitor to the voltage of the smoothing capacitor decreases, it is preferably set such that the ratio does not become too low. For example, when the alternating-current voltage is 100 volts, the voltage of the output capacitor is set equal to or less than half the alternating-current voltage, and this makes it easier to make the voltage of the smoothing capacitor higher than the voltage of the output capacitor during the entire period of the alternating-current period. In order to relatively increase the circuit efficiency, the number of light-emitting diodes connected, as the load, in series between the output terminals is preferably set such that the voltage of the output capacitor ranges from 35 to 48 volts. When the voltage falls within this range, the circuit efficiency is equal to or more than 89%, the problem resulting from the harmonic is prevented under a practical condition of 25 W or less even if variations in the properties of components such as the smoothing capacitor, the harmonic standard is satisfied, the step-down chopper is stably operated during the entire period of the alternating-current period without causing brightness of flickering and the high circuit efficiency is obtained to achieve high practicality.

When the alternating-current power supply voltage exceeds 100 volts, in order to keep the voltage of the output capacitor within, for example, the above-described low range, the voltage drop ratio of the step-down chopper may be set relatively high. In this way, it is possible to obtain the same effects although a circuit power factor is slightly lowered.

DETAILED DESCRIPTION OF THE PREFERRED EMBODIMENT

Embodiments of the present invention will be described below with reference to the accompanying drawings.

Figure 1:
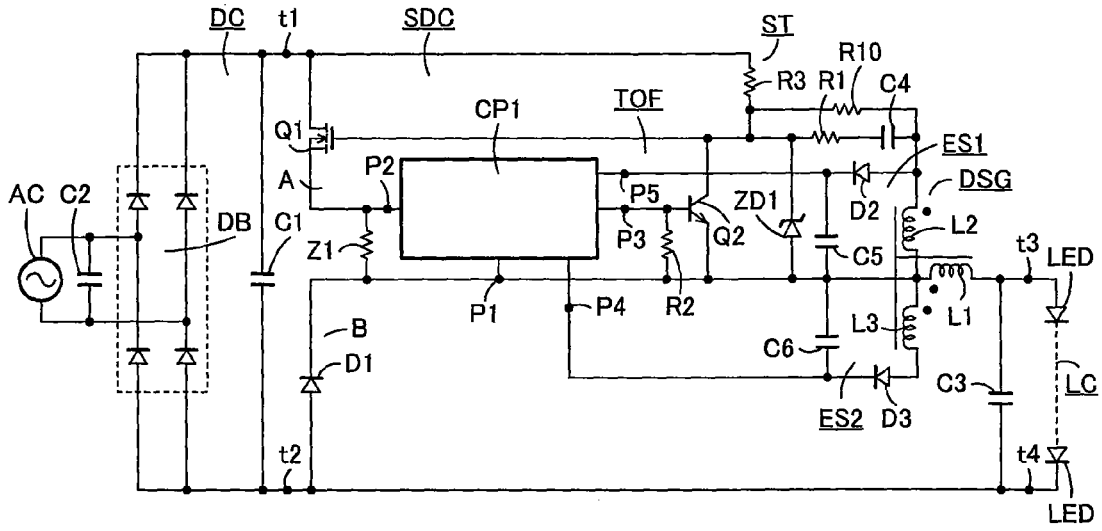
FIG. 1 is a circuit diagram showing an embodiment for embodying an LED lighting device according to the present invention.

FIG. 1 is a circuit diagram showing an embodiment for embodying an LED lighting device according to the present invention.

The LED lighting device includes a direct-current power supply DC, a step-down chopper SDC, light-emitting diode LEDs, a self-excited drive signal generation circuit DSG and a turn-off circuit TOF. The self-excited drive signal generation circuit DSG and the turn-off circuit TOF constitute a self-excited drive circuit. In addition to these components, a start-up circuit ST is provided.

The direct-current power supply DC is provided with: a full-wave rectification circuit DB whose input terminals are connected to an alternating-current power supply AC such as a commercial alternating-current power supply having, for example, a rated voltage of 100V; and a smoothing capacitor C1. The smoothing capacitor C1 is connected to the output terminals of the full-wave rectification circuit DB. A capacitor C2 that is connected to the input terminals of the full-wave rectification circuit DB is a noise prevention capacitor C2.

The step-down chopper SDC is provided with: input terminals ti and t2 connected to the direct-current power supply DC; output terminals t3 and t4 connected to a load; a switching element Q1; a first circuit A that includes impedance means Z1 and a first inductor L1 connected in series and that is connected between the input terminal t1 and the output terminal t3; and a second circuit B that includes the first inductor L1 and a diode D1 connected in series and that is connected between the output terminals t3 and t4. Between the output terminals t3 and t4, an output capacitor C3 serving as a smoothing capacitor is connected.

The switching element Q1 of the step-down chopper SDC is formed with a FET (field effect transistor); the drain and the source thereof are connected to the first circuit A. The first circuit A forms the charging circuit of the first inductor L1 via the output capacitor C3 and/or a load circuit LC which will be described later; the second circuit B and the diode D1 form the discharging circuit of the first inductor L1 via the first inductor L1 and the output capacitor C3 and/or the load circuit LC which will be described later, respectively. Although the impedance means Z1 is formed with a resistor, an inductor or a capacitor having a resistance component of appropriate magnitude can be used as desired.

A desired number of light-emitting diode LEDs are used, these light-emitting diode LEDs are connected in series to form the load circuit LC and this load circuit LC is connected to the output terminals t3 and t4 of the step-down chopper SDC.

The self-excited drive signal generation circuit DSG is provided with a second inductor L2 that is magnetically coupled with the first inductor L1 of the step-down chopper SDC. A voltage induced in the second inductor L2 is applied, as a drive signal, between the control terminal (gate) and the drain of the switching element Q1, with the result that the switching element Q1 is kept on. The other terminal of the second inductor L2 is connected via the impedance means Z1 to the source of the switching element Q1.

In addition to the configuration described above, in the self-excited drive signal generation circuit DSG, a series circuit composed of a capacitor C4 and a resistor R1 is interposed in series between one end of the second inductor L2 and the control terminal (gate) of the switching element Q1. A Zener diode ZD1 is connected between the output terminals of the self-excited drive signal generation circuit DSG, and thus an overvoltage protection circuit is formed so as to prevent the switching element Q1 from being broken by the application of an overvoltage between the control terminal (gate) and the drain of the switching element Q1.

The turn-off circuit TOF is provided with a comparator CP1 serving as comparison means, a switching element Q2 and first and second control circuit power supplies ES1 and ES2. The terminal P1 of the comparator CP1 is a terminal on the side of the base potential of a reference voltage circuit inside the comparator CP1 and is connected to the connection point between the impedance means Z1 and the first inductor L1. The reference voltage circuit is provided within the comparator CP1; it receives, from the second control circuit power supply ES2, power at a terminal P4 to generate a reference voltage and applies the reference voltage to the non-inverting input terminal of an operational amplifier within the comparator CP1. A terminal P2 is the input terminal of the comparator CP1 and is connected to the connection point between the first switching element Q1 and the impedance means Z1, and thus an input voltage is applied to the inverting input terminal of the operational amplifier of the comparator CP1. A terminal P3 is the output terminal of the comparator CP1 and is connected to the base of the switching element Q2, and thus an output voltage is applied from the comparator CP1 to the switching element Q2. A terminal P5 is connected to the first control circuit power supply ES1, and thus control power is supplied to the comparator CP1.

The switching element Q2 is formed with a transistor, and its collector is connected to the control terminal of the first switching element Q1 and its emitter is connected to the connection point between the impedance element Z1 and the first inductor L1. Therefore, when the switching element Q2 is turned on, the output terminals of the self-excited drive signal generation circuit DSG are short-circuited, with the result that the switching element Q1 is turned off. A resistor R2 is connected between the base and the emitter of the switching element Q2.

In the first control circuit power supply ES1, a series circuit composed of a diode D2 and a capacitor C5 is connected across the second inductor L2; with a voltage induced by the second inductor L2 when the first inductor L1 is charged, the capacitor C5 is charged through the diode D2, and a positive potential is output from the connection point between the diode D2 and the capacitor C5 such that a control voltage is applied to the output terminal of the comparator CP1.

In the second control circuit power supply ES2, a series circuit composed of a diode D3 and a capacitor C6 is connected across a third inductor L3 that is magnetically coupled to the first inductor L1. With a voltage induced by the third inductor L3 when the first inductor L1 is discharged, the capacitor C6 is charged through the diode D3, and a positive voltage is output from the connection point between the diode D3 and the capacitor C6 such that a control voltage is applied to the reference voltage circuit of the comparator CP1 and the reference voltage is generated in the reference voltage circuit.

The start-up circuit ST is composed of: a series circuit consisting of a resistor R3 connected between the drain and the gate of the first switching element Q1, the resistor R1 of the self-excited drive signal generation circuit DSG and a resistor R10 connected in parallel to the capacitor C4; and a series circuit consisting of the second inductor L2 and the output capacitor C3 in the second circuit B of the step-down chopper SDC and/or the light-emitting diode LEDs in the load circuit LC. When the direct-current power supply DC is turned on, a positive start-up voltage determined largely by the ratio between the resistance of the resistor R3 and the resistance of the resistor R10 is applied to the gate of the first switching element Q1, with the result that the step-down chopper SDC is started up.

The operation of the circuit of the LED lighting device will now be described.

When the direct-current power supply DC is turned on, and the step-down chopper SDC is started up by the start-up circuit ST, the switching element Q1 is turned on, and a linearly increasing current is started to flow from the direct-current power supply DC within the first circuit A through the output capacitor C3 and/or the light-emitting diode LEDs in the load circuit LC. This increasing current allows a voltage whose positive polarity is on the side of the capacitor C4 to be induced in the second inductor L2 of the self-excited drive signal generation circuit DSG, and this induced voltage allows a positive voltage to be applied to the control terminal (gate) of the switching element Q1 through the capacitor C4 and the resistor R1, with the result that the switching element Q1 is kept on and that the increasing current continues to flow. At the same time, the increasing current causes a voltage drop in the impedance means Z1, and the dropped voltage is applied, as an input voltage, to the terminal P2 of the comparator CP1 in the turn-off circuit TOF.

As the increasing current increases, the input voltage of the comparator CP1 increases and then exceeds the reference voltage, with the result that the comparator CP1 is operated and this generates a positive output voltage at the terminal P3. Consequently, since the switching element Q2 in the turn-off circuit TOF is turned on, and thus the output terminals of the self-excited drive signal generation circuit DSG are short-circuited, the switching element Q1 of the step-down chopper SDC is turned off, and thus the increasing current is interrupted.

When the switching element Q1 is turned off, the increasing current flows through the first inductor L1, and thus electromagnetic energy stored in the first inductor L1 is discharged, with the result that a decreasing current is started to flow within the second circuit B including the first inductor L1 and the diode D1 through the output capacitor C3 and/or the light-emitting diode LEDs in the load circuit LC. This decreasing current allows a voltage whose negative polarity is on the side of the capacitor C4 to be induced in the second inductor L2 of the self-excited drive signal generation circuit DSG, and this induced voltage allows a negative potential to be applied to the capacitor C4 through the Zener diode ZD1 and also allows a zero potential to be applied to the control terminal (gate) of the switching element Q1, with the result that the switching element Q1 is kept off and that the decreasing current continues to flow.

When the discharge of the electromagnetic energy stored in the first inductor L1 is completed, and then the decreasing current reaches zero, a back electromotive force is generated in the first inductor L1, and thus the voltage induced in the second inductor L2 is reversed and the side of the capacitor C4 becomes positive. Hence, when this induced voltage allows a positive voltage to be applied to the control terminal (gate) of the switching element Q1 through the capacitor C4 and the resistor R1, the switching element Q1 is turned on again, and thus the increasing current starts to flow again.

Thereafter, the same circuit operation as described above is repeated, and the increasing current and the decreasing current are combined together, and thus a triangular load current flows, with the result that the light-emitting diode LEDs in the load circuit LC are lit.

In the above-described circuit operation, the operation of the turn-off circuit TOF is performed in two stages, one done with the comparator CP1, the other done with the switching element Q2, and thus, even if the input voltage of the comparator CP1 is 0.3 volts or less, stable and accurate operation is achieved. This makes it possible to reduce the resistance of the impedance means Z1, and thus, even when an input voltage is 0.5 volts in the conventional technology, with the present invention, it is possible to reduce the power loss of the impedance means Z1 by 40% or more as compared with the conventional technology.

Since the temperature characteristic of the turn-off circuit TOF is determined by the side of the comparator CP1, and thus a desired satisfactory temperature characteristic can be provided for the comparator CP1, the conventional problem in which the temperature characteristic is attributable to the temperature characteristic of the switching element Q2 is solved. Since, with respect to the temperature characteristic of the comparator CP1, for example, as the Zener diode used in the reference voltage circuit of the comparator CP1, it is easy to select the Zener diode whose temperature characteristic is slightly negative or flat, such a characteristic can be given as the temperature characteristic of the comparator CP1. Thus, it is possible to obtain an LED lighting device with a satisfactory temperature characteristic.

Moreover, the provision of the comparator CP1 in the turn-off circuit TOF allows the switching element Q2 to operate stably and accurately, and this reduces variations in the output of the LED lighting device.

When the direct-current power supply DC is provided with the full-wave rectification circuit DB, the operation of the step-down chopper SDC is unstable during a period in which an instantaneous value of a rectified alternating-current half-wave voltage is lower than the operating voltage of the load circuit LC, with the result that, during this period, the load current is not supplied. Thus, it is more likely that flickering is caused in light emitted by the light-emitting diode LEDs in the load circuit LC. Even if, in order for this problem to be overcome, the smoothing capacitor C1 is connected to the direct-current output terminal of the direct-current power supply DC, an abrupt charging current flows through the smoothing capacitor C1 and thus the harmonics of the input current are increased. Therefore, it is necessary to reduce the harmonics to a required level. Thus, an LED lighting device is required that meets a harmonic standard in which a harmonic distortion is 25 W or less and that has means for achieving practical circuit efficiency. For example, in Japan, for a relatively small LED lighting device having a load of 25 W or less, such a standard is "JIS C61000-3-2 Class C" that is a harmonic standard for 25 W or less and that specifies that the phase of an input current peak θ must be 65° or less, that the content of the third harmonic must be 86% or less and that the content of the fifth harmonic must be 61% or less. In short, in order to reduce the harmonics, it is necessary to improve the phase of the input current and the proportion of the third and fifth harmonic components such that they each reach required levels.

To achieve the foregoing, the proportion of the fifth harmonic of the input current waveform of the step-down chopper SDC is kept at 60% or less, and the voltage of the smoothing capacitor C1 is kept higher than the voltage of the output capacitor C3 over the entire range of an alternating-current voltage period, with the result that the harmonic of the input current is reduced, that the step-down chopper SDC is stably operated during the entire time period of the alternating-current voltage period and that it is possible to prevent brightness of flickering of light-emitting diode LEDs. Furthermore, it is possible to set the voltage of the output capacitor C3, specifically, the load voltage within a range of 35 to 48 volts, and, within this range, it is also possible to increase the circuit efficiency to 89% or more. Therefore, this is preferable to a relatively small LED lighting device that can be applied to a bulb lamp that can replace an incandescent bulb used by being connected to an alternating-current power supply AC of 100 volts or more.

A preferred method of setting the capacitance of the smoothing capacitor C1 will now be described with reference to FIGS. 2 to 4. Specifically, a preferred method of setting the capacitance of the smoothing capacitor C1 that is used to obtain a practical LED lighting device that meets the above-described harmonic standard in which the harmonic distortion is 25 W or less, that makes the circuit operate stably and that prevents brightness of flickering of the light-emitting diode LEDs will be described.

Figure 2:
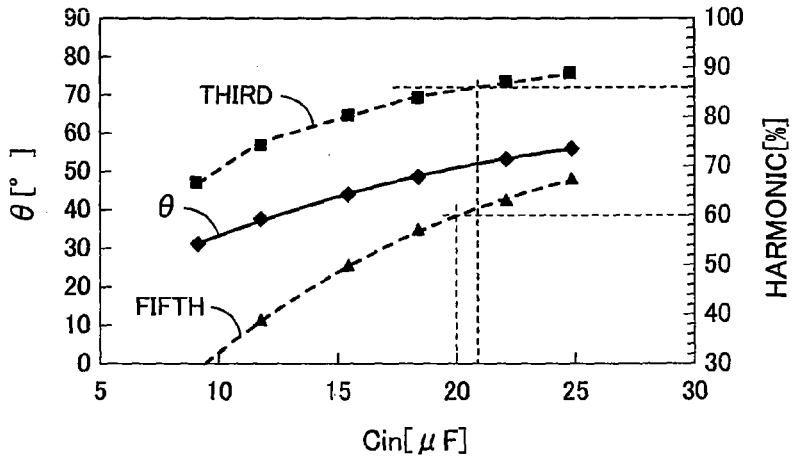
FIG. 2 is a graph showing the relationship between the capacity of a smoothing capacitor in a direct-current power supply, the phase of an input current peak and the components of harmonics.

FIG. 2 is a graph showing the relationship between the capacity of the smoothing capacitor C1 in the direct-current power supply DC, the phase of the input current peak and the components of the harmonics. In FIG. 2, the horizontal axis indicates the capacity $C_{in}$ (μF) of the smoothing capacitor C1, the vertical axis on the left indicates the phase θ of the input current peak and the vertical axis on the right indicates the harmonic (%) indicating the harmonic component. The symbol "θ" attached to the curve in the figure indicates the phase of the input current peak, the "the third" indicates the third harmonic component proportion and the "the fifth" indicates the fifth harmonic component proportion.

As is understood from FIG. 2, when, in the direct-current power supply DC in which the alternating-current power supply AC of 100 AC V is rectified, the capacitance of the smoothing capacitor C1 practically ranges from 8 to 25 μF, the phase "θ" of each input current peak satisfies a standard limit of 65° or less, with the result that no problem occurs. When the capacitance of the smoothing capacitor C1 is equal to or less than about 22 μF, the third harmonic component proportion "the third" satisfies a standard limit of 86% or less, with the result that no problem occurs. When the capacitance of the smoothing capacitor C1 is equal to or less than about 20 μF, the fifth harmonic component proportion "the fifth" satisfies a standard limit of 61% or less, with the result that no problem occurs.

Hence, the capacitance of the smoothing capacitor C1 in the direct-current power supply DC is optimally 15 μF, and satisfies the standard when it ranges from 10 to 20 μF in consideration of variations in the properties of components. The capacitance preferably ranges from 12 to 18 μF.

Figure 3:
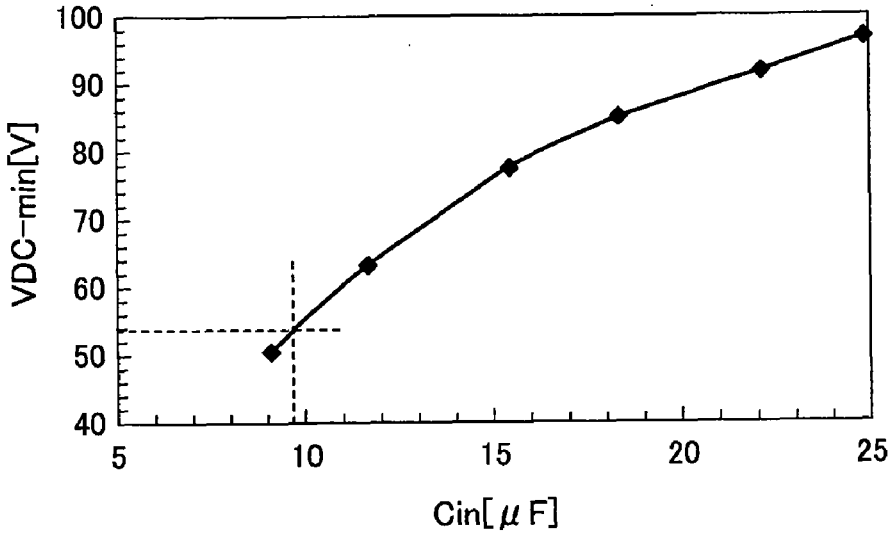
FIG. 3 is a graph showing the relationship between the capacity of the smoothing capacitor in the direct-current power supply and the lowest value of a voltage ripple in the direct-current power supply.

FIG. 3 is a graph showing the relationship between the capacity of the smoothing capacitor C1 in the direct-current power supply DC and the lowest value of a voltage ripple in the direct-current power supply DC. In FIG. 3, the horizontal axis indicates the capacity $C_{in}$ (μF) of the smoothing capacitor C1, and the vertical axis indicates the lowest value VDC-min (V) of the voltage ripple in the direct-current power supply DC. The lowest value of the voltage ripple is obtained when the capacity of the smoothing capacitor C1 is lowered at the end of the life thereof.

As is understood from FIG. 3, an electrolytic capacitor used as the smoothing capacitor C1 is lowered in capacity at the end of the life, and the lowest value of a voltage ripple tends to be lowered accordingly; when the capacity is about 10 μF, the lowest value of the voltage ripple is 53 volts. The output voltage of the step-down chopper SDC is equal to or less than the input voltage with respect to 100 volts of the AC power supply voltage, and, in order to continue the operation of the step-down chopper SDC even when the voltage ripple of the input voltage is the lowest value, it is necessary to make the output voltage of the step-down chopper SDC equal to or less than the lowest value of the voltage ripple. During the entire time period of the alternating-current voltage period, the voltage of the smoothing capacitor C1 needs to be higher than that of the output capacitor C3.

Since, in order to stably perform the switching of the step-down chopper SDC, it is further necessary to have a tolerance of 5 volts or more, the voltage of the output capacitor C3 (hence, the load voltage) when the 100V AC power supply is used is preferably set at half or less of the input voltage, more preferably, 48 volts or less.

Figure 4:
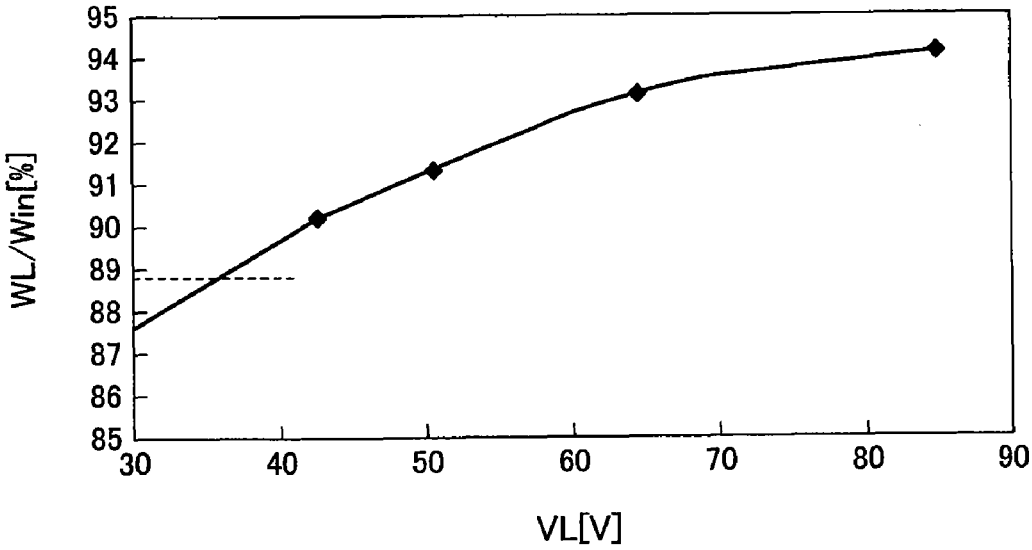
FIG. 4 is a graph showing the relationship between the output voltage of a step-down chopper and the efficiency of a circuit.

As is understood from FIG. 4, as the voltage of the output capacitor C3 is lowered with respect to the voltage of the smoothing capacitor C1, the efficiency of the circuit tends to be lowered. When the 100V AC power supply is used, in order to obtain a circuit efficiency of 89% or more, it is preferable to make the voltage of the output capacitor C3 equal to or more than about 35 volts. Therefore, when the voltage of the output capacitor C3 ranges from 35 to 48 volts, it is possible to obtain an LED lighting device that meets the harmonic standard, that achieves the stable circuit operation without causing brightness of flickering and that further has high circuit efficiency.

In summary, when the capacity of the smoothing capacitor C1 is set to range from 10 to 20 μF (preferably, from 12 to 18 μF), and the output voltage is set to range from 35 to 48 volts, it is possible to obtain an LED lighting device that meets the harmonic standard in which the harmonic distortion is 25 W or less and that has a practical circuit efficiency.

If the high circuit efficiency is not required, according to the present invention, even when the voltage of the output capacitor C3 is 35 volts or less, and, in other words, the AC voltage AC is more than 100 volts, it is possible to obtain an LED lighting device that meets the harmonic standard, that achieves the stable circuit operation and that prevents brightness of flickering of the light-emitting diode LEDs.

Figure 5:
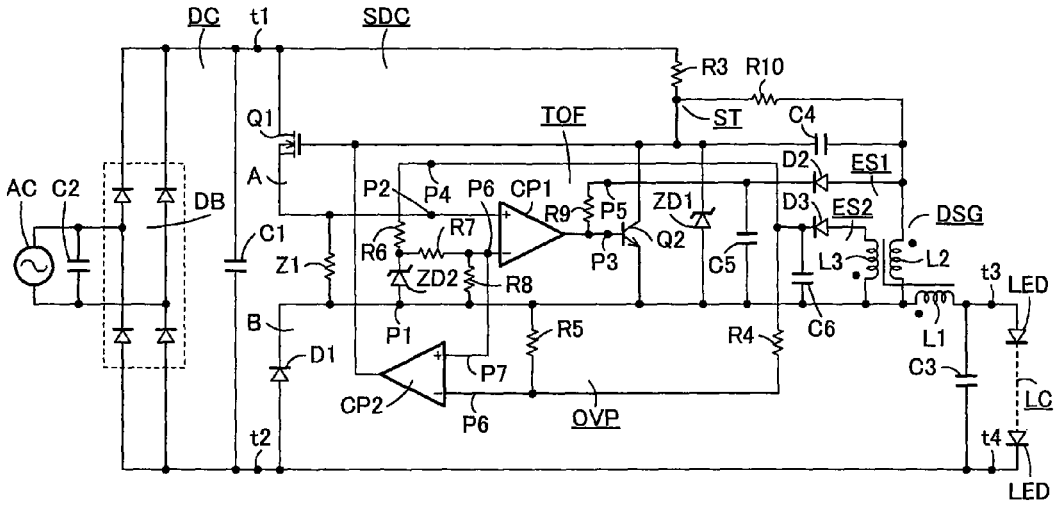
FIG. 5 is a circuit diagram showing another embodiment for embodying an LED lighting device according to the present invention.

FIG. 5 is a circuit diagram showing another embodiment for embodying an LED lighting device according to the present invention. In the figure, the same parts as FIG. 1 are identified with common symbols, and their description will be omitted. This embodiment mainly differs from the above embodiment in that an overvoltage protection circuit OVP is added.

The overvoltage protection circuit OVP is mainly composed of the second control circuit power supply ES2 and a comparator CP2.

The second control circuit power supply ES2 is the same as the embodiment shown in FIG. 1. One end of a series circuit composed of a resistor R4 and a resistor R5 and one end of a series circuit composed of a resistor R6 and a Zener diode ZD2 are connected in parallel to the connection point between the diode D3 and the capacitor C6.

The inverting input terminal P6 of the comparator CP2 is connected to the connection point between the resistor R4 and the resistor R5; the series circuit composed of the resistor R4 and the resistor R5 is connected in parallel to the capacitor C6 in the second control circuit power supply ES2. The resistor R4 and the resistor R5 constitute a voltage divider circuit, and the terminal voltage of the resistor R5 obtained by voltage division, is applied to the inverting input terminal P6.

The non-inverting input terminal P7 of the comparator CP2 is connected to the reference voltage circuit of the comparator CP1, and hence is connected to the input terminal P2 of the comparator CP1. The reference voltage circuit of the comparator CP1 constitutes a constant voltage portion and a reference voltage output portion. The constant voltage portion is formed with the series circuit composed of the resistor R6 and the Zener diode ZD2, and is connected in parallel to the capacitor C6 of the second control circuit power supply ES2. The reference voltage output portion of the reference voltage circuit of the comparator CP1 is formed with a division circuit that is connected in parallel to the Zener diode ZD2 and that is composed of a resistor R7 and a resistor R8; the terminal voltage of the resistor R8 obtained by voltage division is output as the reference voltage. The reference voltage is applied to the inverting input terminal P6 of the operational amplifier of the comparator CP1 and is also applied to the non-inverting input terminal P7 of the comparator CP2. The terminal P1 is the connection point between the resistor R8 and the anode of the Zener diode ZD2.

On the other hand, the non-inverting input terminal of the operational amplifier of the comparator CP1 is connected to the terminal P2, and the output terminal is connected to the terminal P3 and is also connected to the terminal P5 via resistor R9.

When, while the light-emitting diode LEDs in the load circuit LC are lit, the step-down chopper SDC becomes defective due to any reason and thus its output becomes overvoltage, since the output voltage of the third inductor L3 that is magnetically coupled with the first inductor L1 and that is induced by a voltage at the time of the discharge of the first inductor L1 is proportional to the output voltage of the step-down chopper SDC, the terminal voltage of the capacitor C6 in the second control circuit power supply ES2 is proportionally increased. Consequently, the terminal voltage of the capacitor C6 is divided by the resistors R4 and R5, and the voltage input to the inverting input terminal P6 of the comparator CP2 exceeds the reference voltage, with the result that a negative output voltage is output from a terminal P9. For this reason, the potential of the control terminal (gate) of the first switching element Q1 becomes negative, and thus the first switching element Q1 is turned off, and the light-emitting diode LEDs are turned off to be protected. Thereafter, the setting of the ratio between the resistances of the resistors R3 and R10 in the start-up circuit ST makes it impossible to perform the restart. The other circuit operations are performed in the same manner as the embodiment shown in FIG. 1.

Figure 6:
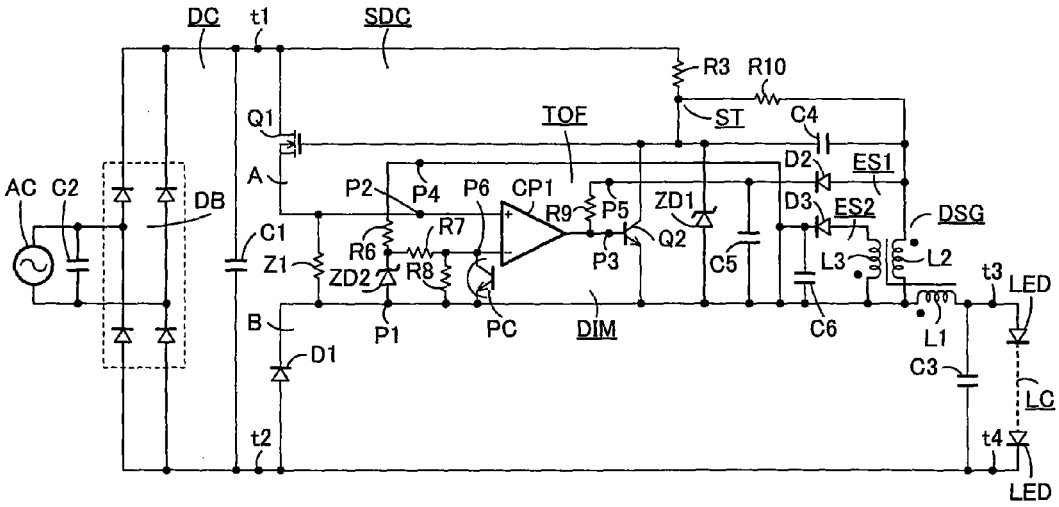
FIG. 6 is a circuit diagram showing a further embodiment for embodying an LED lighting device according to the present invention.
Figure 7:
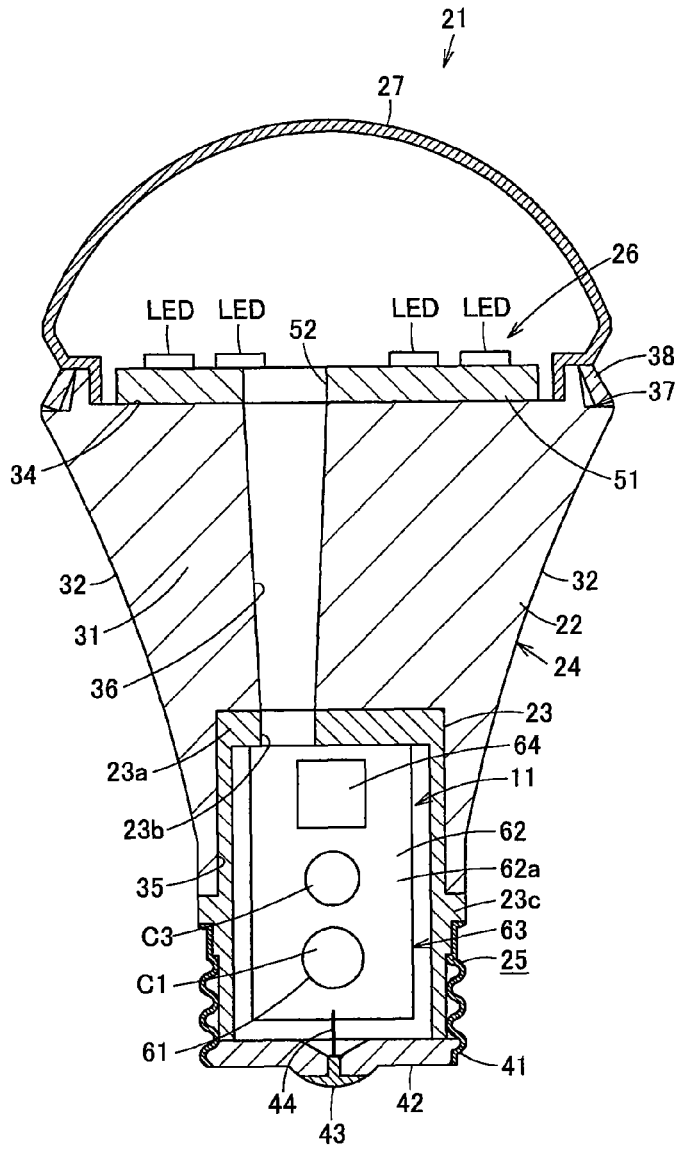
FIG. 7 is a vertical cross-sectional view of a bulb lamp using the LED lighting device of the present invention.
Figure 8:
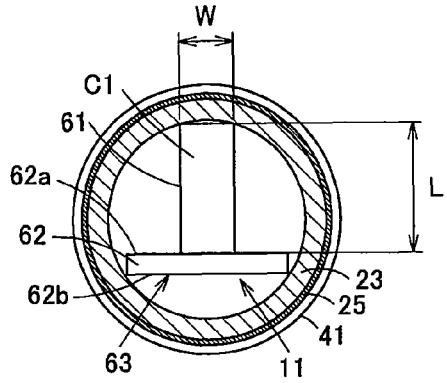
FIG. 8 is a horizontal cross-sectional view of a base of the bulb lamp.
Figure 9:
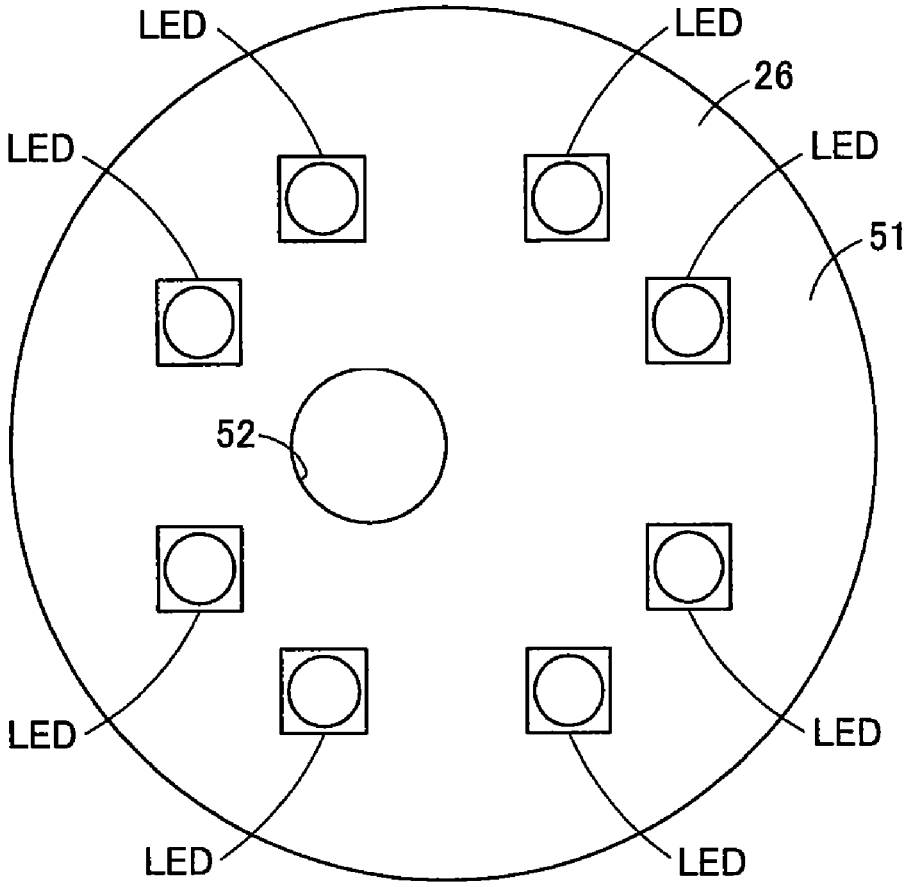
FIG. 9 is a plan view of an LED module of the bulb lamp.
Figure 10:
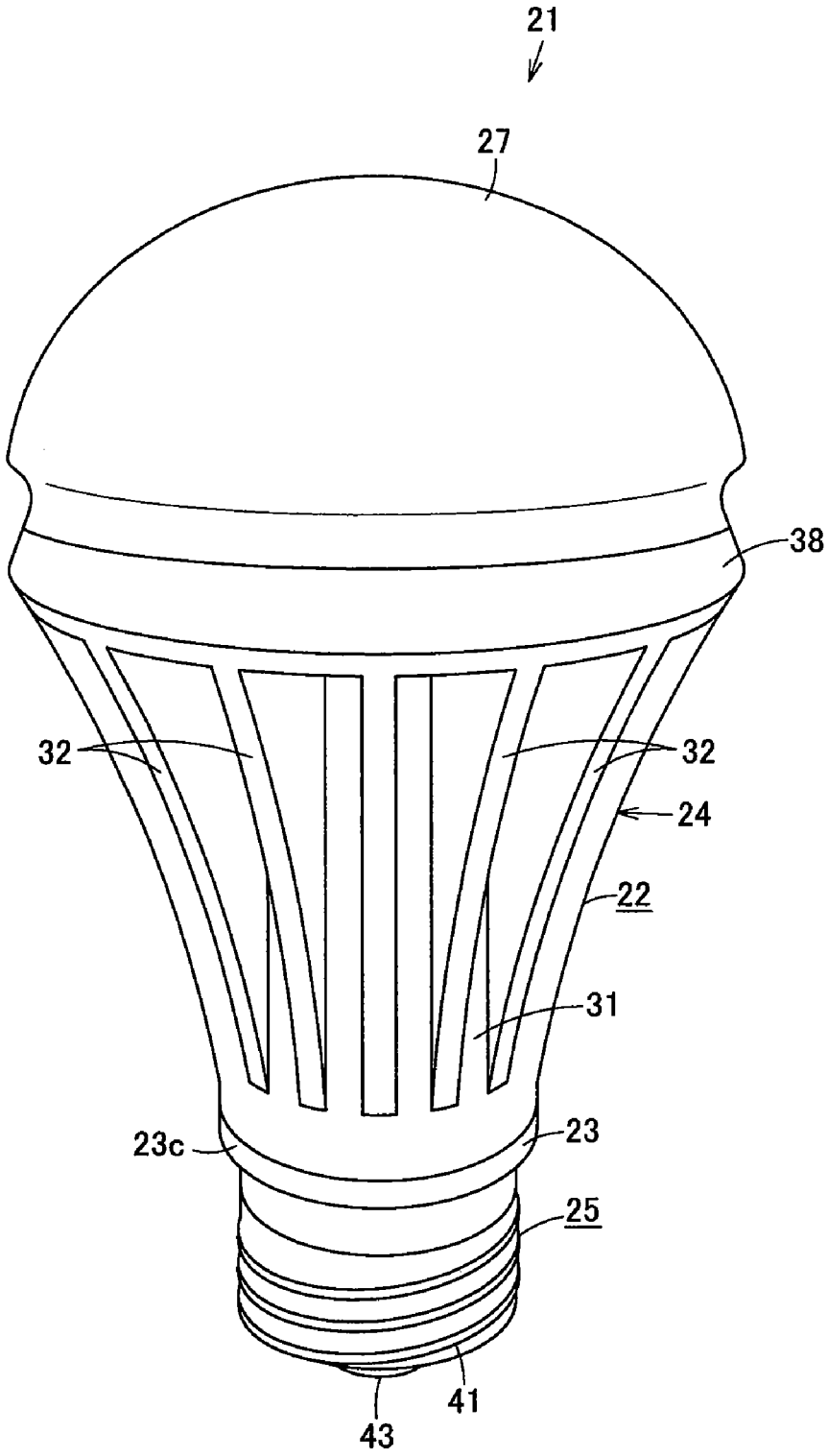
FIG. 10 is a side view of the bulb lamp.

FIG. 6 is a circuit diagram showing another embodiment for embodying an LED lighting device according to the present invention. In the figure, the same parts as FIGS. 1 and 5 are identified with common symbols, and their description will be omitted. This embodiment mainly differs from the above embodiment in that a light adjustment control circuit DIM is added.

In the light adjustment control circuit DIM, a phototransistor serving as a light receiver of a photocoupler PC is connected in parallel to the resistor R8 in the reference voltage circuit of the comparator CP1, and an unillustrated light emitter is connected to the output terminal of a light adjustment signal generation circuit.

When light of a PWM light adjustment signal is emitted by the light receiver of the photocoupler PC, the photo transistor serving as the light receiver receives the light to turn on and off. While the phototransistor is kept on, the output of the reference voltage circuit is short-circuited to be substantially zero, and the switching element Q2 is turned on and the switching element Q1 is turned off, with the result that almost no current flows through the load circuit LC. As the light adjustment proceeds, the light adjustment signal increases the on-duty of the photocoupler PC.

Thus, by varying the on-duty of the photocoupler PC with the light adjustment signal, it is possible to light the light-emitting diode LEDs in the load circuit LC and adjust the light.

In FIGS. 7 to 10, a bulb lamp 21 using the above-described LED lighting device is shown.

The bulb lamp 21 is provided with: a main body 24 having a heat dissipation member 22 and a case 23 attached to one end of the heat dissipation member 22; a base 25 attached to one end of the case 23; an LED module substrate 26 attached to the other end of the heat dissipation member 22; a globe 27 covering the LED module substrate 26; and the LED lighting device 11.

The heat dissipation member 22 is provided with: a heat dissipation member main body 31 whose diameter is gradually increased from the base 25 on one end to the LED module substrate 26 on the other end; and a plurality of heat dissipation fins 32 formed on the outer circumferential surface of the heat dissipation member main body 31. The heat dissipation member main body 31 and the heat dissipation fins 32 are formed, integrally with each other, of metallic material such as aluminum having a satisfactory heat conductivity, resin material or the like.

In the heat dissipation member main body 31, on the other end, an attachment recess portion 34 to which the LED module substrate 26 is attached is formed, and, on the one end, a fit recess portion 35 into which the case 23 is inserted is formed. Moreover, in the heat dissipation member main body 31, an insertion through-hole portion 36 that communicates with the attachment recess portion 34 and the fit recess portion 35 and that penetrates the heat dissipation member main body 31 is formed. Furthermore, on a circumferential portion on the other end of the heat dissipation member main body 31, a groove portion 37 is formed along the circumference to face one end of the globe 27.

The heat dissipation fins 32 are obliquely formed such that the amount of protrusion thereof in a radial direction is gradually increased from the one end to the other end of the heat dissipation member main body 31. The heat dissipation fins 32 are formed and substantially evenly spaced in a circumferential direction of the heat dissipation member main body 31.

The insertion through-hole portion 36 is formed such that its diameter is gradually increased from the case 23 to the LED module substrate 26.

A ring 38 for reflecting light diffused downward from the groove 27 is attached to the groove portion 37.

The case 23 is formed of an insulating material such as PBT resin such that it is substantially cylindrically shaped to fit the shape of the fit recess portion 35. The one end of the case 23 is blocked by a blocking plate 23*a* serving as a case blocking portion; in the blocking plate 23*a*, a communication hole 23*b* that has substantially the same diameter as the insertion through-hole portion 36 and that communicates with the insertion through-hole portion 36 is formed to be open. In the outer circumferential surface of an intermediate portion between the one end and the other end of the case 23, a flange portion 23*c* serving as an insulating portion to insulate the area between the heat dissipation member main body 31 of the heat dissipation member 22 and the base 25 is continuously formed to protrude in a radial direction around the circumference.

The base 25 is E26 type; it is provided with: a cylindrical shell 41 having screw threads that are screwed into the lamp socket of an unillustrated lighting fitting; and an eyelet 43 that is formed via an insulating portion 42 in the top portion on one end of the shell 41.

The shell 41 is electrically connected to a power supply; inside the shell 41, between the shell 41 and the case 23, an unillustrated power line for supplying power to the LED lighting device 11 is sandwiched to bring the shell 41 into conduction.

The eyelet 43 is electrically connected to an unillustrated ground potential and the ground potential of the LED lighting device 11 via a lead wire 44.

In the LED module substrate 26, over a substrate 51 that is disc-shaped in a plan view, a plurality of light-emitting diode LEDs are mounted. This substrate 51 is formed of metallic material such as aluminum having satisfactory heat dissipation or is a metal substrate formed of material such as an insulating material; the substrate 51 is fixed to the heat dissipation member 22 with an unillustrated screw or the like such that the surface opposite from the surface where the light-emitting diode LEDs are mounted makes close contact with the heat dissipation member 22. In the substrate 51, in a position slightly displaced with respect to the center position, an interconnection hole 52 that communicates with the insertion through-hole portion 36 of the heat dissipation member 22 and that is shaped in the form of a round hole is formed to be open. The substrate 51 may be bonded to the heat dissipation member 22 with a silicon adhesive having excellent heat dissipation or the like.

Through the interconnection hole 52, unillustrated wiring connected electrically between the lighting circuit of the LED lighting device 11 and the LED module substrate 26 is passed. In the vicinity of the interconnection hole 52, an unillustrated connector receiving portion for connecting a connector disposed at an end portion of the wiring is mounted on the substrate 51.

On the outer edge portion of the LED module substrate 26, the light-emitting diode LEDs are disposed substantially spaced on the same circumference having their center in the center position of the LED module substrate 26.

The light-emitting diode LED is provided with: an unillustrated bare chip that emits, for example, light of blue color; and an unillustrated resin portion that is formed of material such as silicon resin covering the bare chip. In the resin portion, an unillustrated fluorescence substance is contained that is excited by part of the blue light emitted from the bare chip to mainly emit light of yellow color that is the complementary color of the blue color, with the result that each light-emitting diode LED obtains illumination light of white color.

The globe 27 is formed of material such as glass or synthetic resin having light diffusion properties in the shape of a flat spherical surface, and is continuous with the other end of the heat dissipation member main body 31 of the heat dissipation member 22. The globe 27 is formed such that the diameter of its opening is gradually increased toward the one end thereof, that the diameter is gradually decreased from the maximum diameter position toward the one end and that the maximum diameter position is located above the light-emitting diode LEDs on the LED module substrate 26.

The LED lighting device 11 is provided with a substrate unit 63 composed of a plurality of lighting circuit components 61 and a rectangular flat-plate-shaped substrate 62 on which these lighting circuit components 61 are mounted.

The substrate 62 is vertically placed along the direction of the center axis of the base 25, and its longitudinal direction is disposed along the direction of the center axis of the base 25, and the substrate 62 is positioned offset with respect to the center axis of the base 25 and is disposed within the case 23. One end of the substrate 62 is disposed within the base 25. In the inner surface of the case 23, unillustrated supporting groove portions are formed that support both edge portions of the substrate 62 that is inserted through an opening portion of the one end of the case 23.

On one substrate surface 62*a* in which a space between the substrate 62 and the base 25 is large, the cylindrical smoothing capacitor C1 and the output capacitor C3 are disposed such that their longitudinal direction is perpendicular to the substrate surface 62*a* and that they are located at the center of their width direction along the direction of the center axis of the base 25 side by side in parallel to each other.

As the smoothing capacitor C1, one having a relatively small capacity is selected such that, within the range conforming to the harmonic standard previously described, a current continuously flows through the light-emitting diode LEDs, specifically, the alternating-current power supply AC is rectified by a rectification element DB but is then not completely smoothed out so as to be a direct current having some ripples left. As the output capacitor C3, one having a capacity that can prevent the harmonic current from flowing through the light-emitting diode LEDs is selected. The capacitors C1 and C3 have a width (diameter) W of 8 mm or less and a length L of 11 mm or less.

The end portions of the capacitors C1 and C3 may make contact with the inner surface of the case 23. In this way, heat generated by the capacitors C2 and C3 is thermally conducted via the case 23 to the base 25, and can be discharged into a lamp socket or the like connected to the base 25.

On the substrate surface 62*a* of the substrate 62, on the other end opposite from the base 25, in the center of the width direction of the substrate surface 62*a*, an inductance element 64 composed of the inductors L1, L2 and L3 and the like are disposed adjacent to the capacitors C1 and C3.

Among the lighting circuit components 61 of the LED lighting device 11, large-sized components such as the capacitors C1 and C3 and the inductance element 64 are disposed on the substrate surface 62*a* of the substrate 62, and small-sized components such as chip components are disposed both on the substrate surface 62*a* in which the space between the substrate 62 and the base 25 is large and on the other opposite substrate surface 62*b* in which the space between the substrate 62 and the base 25 is small in a dispersed manner; these small-sized components are not illustrated.

A filler having heat dissipation and insulating properties, such as silicon resin, may be filled in the case 23 so that the accommodated substrate unit 63 is embedded therein.

The LED lighting device 11 that performs switching control on the load current flowing through the light-emitting diode LEDs in this way is specified such that, as described above, the capacitors C1 and C3 have a width of 8 mm or less and a length of 11 mm or less, and thus it is possible to provide the LED lighting device 11 that can be applied to the bulb lamp 21.

Moreover, within the case 23 of the main body 24 including the base 25, the substrate 62 is used that is vertically placed along the direction of the center line of the base 25 and is disposed offset with respect to the center line of the base 25, and, on the substrate surface 62*a* in which the space between the substrate 62 and the base 25 is large, the capacitors C1 and C3 of the LED lighting device 11 are disposed, with its longitudinal direction being perpendicular to the substrate surface 62*a*, in the center of the width length of the substrate 62 and along the direction of the center line of the base 25 side by side, with the result that it is possible to dispose the capacitors C1 and C3 whose dimensions are specified as described above within the base 25. In this way, it is possible to provide the bulb lamp 21 using the LED lighting device 11 that can perform the switching control on the load current flowing through the light-emitting diode LEDs.

By selecting the capacity and the voltage of the capacitors C1 and C3 such that the output voltage of the LED circuit 13 is kept less than the input voltage thereof, it is possible to relatively increase the capacity even if the output capacitor C3 falls within a predetermined size range. This makes it possible to reduce the ripples of the harmonics and the failures of the lighting of the light-emitting diode LEDs. Although the rated voltage and the capacity of the output capacitor C3 increase with the shape thereof, since the rated voltage is reduced, it is possible to make it fall within the specified dimensions as described above even if the capacity is a little large.

What is claimed is:

1. A light-emitting diode lighting device comprising:

a direct-current power supply;

a step-down chopper including:

an input terminal connected to the direct-current power supply;

an output terminal connected to a load;

a switching element;

a first circuit that includes an impedance device and a first inductor connected in series and that is connected between the input terminal and the output terminal; and a second circuit that includes the first inductor and a diode connected in series and that is connected to the output terminal;

a light-emitting diode connected, as the load, to the output terminal of the step-down chopper;

a self-excited drive signal generation circuit that includes a second inductor magnetically coupled with the first inductor of the step-down chopper and that applies a voltage induced in the second inductor to a control terminal of the switching element as a drive signal to keep the switching element on; and a turn-off circuit including:

a comparison device that detects a voltage of the impedance device in the step-down chopper and that outputs, when the detected voltage exceeds a reference value, an output voltage; and a switch element that is turned on by the output voltage of the comparison device such that an output terminal of the self-excited drive signal generation circuit is short-circuited and that the switching element is thus turned off.

2. The light-emitting diode lighting device according to claim 1, further comprising:

a third inductor magnetically coupled with the first inductor of the step-down chopper; and an overvoltage protection circuit that turns off, when a voltage induced by the third inductor exceeds a predetermined value, the switching element of the step-down chopper.

3. The light-emitting diode lighting device according to claim 1, wherein the direct-current power supply includes a rectification circuit that rectifies an alternating-current voltage and a smoothing capacitor that smoothes out a direct-current voltage resulting from the rectification by the rectification circuit, the step-down chopper includes an output capacitor connected between the output terminals, a proportion of a fifth harmonic of an input current waveform of the step-down chopper is equal to or less than 60% and a voltage of the smoothing capacitor is higher than a voltage of the output capacitor over an entire range of an alternating-current voltage period.

4. The light-emitting diode lighting device of claim 3, wherein an output voltage of the step-down chopper is equal to or less than half the alternating-current voltage.

* * * * *